US006182577B1

(12) United States Patent
Billings

(10) Patent No.: US 6,182,577 B1
(45) Date of Patent: Feb. 6, 2001

(54) AUTOMOBILE TRANSPORT UNIT

(76) Inventor: Calvin Billings, 450 Green Point Ct., Houston, TX (US) 77024

( * ) Notice: Under 35 U.S.C. 154(b), the term of this patent shall be extended for 0 days.

(21) Appl. No.: 09/085,824

(22) Filed: May 28, 1998

Related U.S. Application Data

(60) Provisional application No. 60/047,798, filed on May 28, 1997.

(51) Int. Cl.[7] ..... B61B 13/00

(52) U.S. Cl. ..... 104/242; 104/88.01; 105/26.05; 105/159; 105/1.4; 105/355

(58) Field of Search ..... 104/242, 27, 29, 104/30, 31, 88.01, 88.02, 88.03, 88.04, 172.1, 172.2, 172.3, 173.1, 176, 178, 243; 105/1.4, 26.05, 159, 355; 410/3, 4

(56) References Cited

U.S. PATENT DOCUMENTS 1,611,882 * 12/1926 Budd .
1,788,853 * 1/1931 Becker et al. .
3,691,963 * 9/1972 Krokos et al. .
3,797,407 * 3/1974 Laurent ..... 104/182
4,187,784 * 2/1980 Fernandez et al. ..... 107/173.1
4,944,229 * 7/1990 Arakawa et al. ..... 104/172.3
5,517,923 * 5/1996 Cathiard ..... 104/173.1
5,577,593 * 11/1996 Hooper ..... 198/346.1
5,632,206 * 5/1997 Summa et al. ..... 104/172.3
5,706,735 * 1/1998 Lund ..... 104/88.04
5,775,227 * 7/1998 Mullen ..... 104/88.04

* cited by examiner

*Primary Examiner*—Mark T. Le
(74) *Attorney, Agent, or Firm*—Douglas Baldwin

(57) ABSTRACT

This invention is a transportation system and method of transport the provides a way for transport of vehicles in which the vehicles are loaded onto self-propelled pallets that are coupled to self-propelled apparatus that is in turn coupled to a fixed and predetermined guide.

8 Claims, 7 Drawing Sheets

AUTOMOBILE TRANSPORT UNIT

This application claims priority to U.S. Provisional Patent Application Ser. No. 60/047,798 entitled "Automobile Transport Unit" filed May 28, 1997 by Calvin Billings. New matter has been added to this application for which priority is not claimed.

FIELD OF THE INVENTION

This invention generally relates to an automobile transport unit, and more particularly to a unit having a plurality of cable cars and pallets for transporting automobiles along a main guideway.

BACKGROUND OF THE INVENTION

A crisis is looming on the nation's 4,000,000 miles of streets, roads, and highways. Driven by population growth, the demand for mobility as a fundamental economic need is at odds with our ability to fund and build new highways and maintain a clean environment. There are three major concerns. First is the safety of our highways. It is known that over 40,000 people die on our nation's highways every year. This costs the country over $160 billion in lost lives and in property damage. Second is the congestion. Seventy-nine percent of the nation's interstate highways during peak hours are now congested. And third, there is the problem of environment. The challenge is to plan an intelligent mass transit system so that technology saves lives, time and money, and the environment.

Unfortunately, the problem with all forms of mass transit, such as subways, trains, buses, and planes, is that although they can do a good job of getting you from Point A to Point B, just as important to you, is getting to Point A and from Point B. In fact, mass transit is a misnomer. It can hardly be called "mass" when 96% of the people choose not to use it even when they are paying to subsidize it. It cost more in time, money, and inconvenience to drive to a station, park, get to the station, board, travel to a point near your destination, get off, and then find a means to get to your final destination. When this is all taken into consideration, people elect to use their own automobiles even if at a snail's pace on congested highways. What is needed is a single transportation system taking you from origin to destination rapidly and safely.

Recognizing this failing of mass transit to solve our traffic problems, in 1991 Congress authorized $1 billion to develop an intelligent transportation system. The U.S. Department of Transportation looked at 150 concepts, studied 37 in detail, and ended up with four finalists.

The one seemingly offering the most promise was the automated highway system. An automated highway system is sometimes described in terms of an electronic chauffeur. Everything is done automatically. At a minimum, an automated highway system-capable vehicle requires special on-board systems to provide such functions as lane following, remotely actuated variable throttle/speed control, vehicle-to-vehicle gap sensing, and sophisticated crash avoidance systems. To experience a ride on the automated highway system is to engage in a very unique experience. It is empowering in that you think that in the first instance that you are giving up something when you give up control of the vehicle, but when you recognize that doing so puts you in a much safer environment, and it allows you to operate your vehicle in a much more efficient manner, then you begin to understand how you are actually empowered. Unfortunately, efforts to develop an automated highway system have been dismantled. The simple fact is that a highway lane cannot be taken out of service until there are enough automated cars to use it, and conversely, no one will buy an automated car until there is a lane to drive it and neither will the manufacturers build them.

Another finalist concept is called the pallet. In its simplest design, the pallet concept involves an automated self-propelled vehicle, essentially a cab-less, flatbed truck upon which a conventional full-sized car could be readily loaded and unloaded and carried on some type of automated highway system. Some of the advantages of the pallet concept is that it could be extremely safe and would have universal access. All potential automated highway system users could access a pallet-based system with their existing vehicles. Some of the disadvantages of the pallet concept is that it would take a lot of land space for achieving the entry and exit functions. Further, the storing of pallets would be a problem.

A transportation unit that enables a traveler to never leave his or her car, that is fast, pollution free, safe, and economical, holds much promise.

SUMMARY OF THE INVENTION

This invention generally relates to an automobile transport unit, and more particularly to a unit having a plurality of cable cars and pallets for transporting automobiles along a main guideway.

The foregoing has outlined rather broadly the features and technical advantages of the present invention so that the detailed description of the invention that follows may be better understood. Additional features and advantages to the invention will be described hereinafter which form the subject of the claims of the invention. It should be appreciated by those skilled in the art that the conception and the specific embodiments disclosed may be readily used as a basis for modifying or designing other structures for carrying out the same purposes of the present invention. it should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and form a part of the specification, illustrate the embodiments of the present invention, and, together with the description, serve to explain the principles of the invention. In the drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

The automobile transport unit of the present invention is the most advanced concept in transportation in nearly 100 years. This unit will transport both you and your car electrically on a fixed guideway. You drive from your home, enter the guideway, sit back, relax, read, or work, and are delivered to your exit automatically where you can finish the trip in your car.

Figure 1:
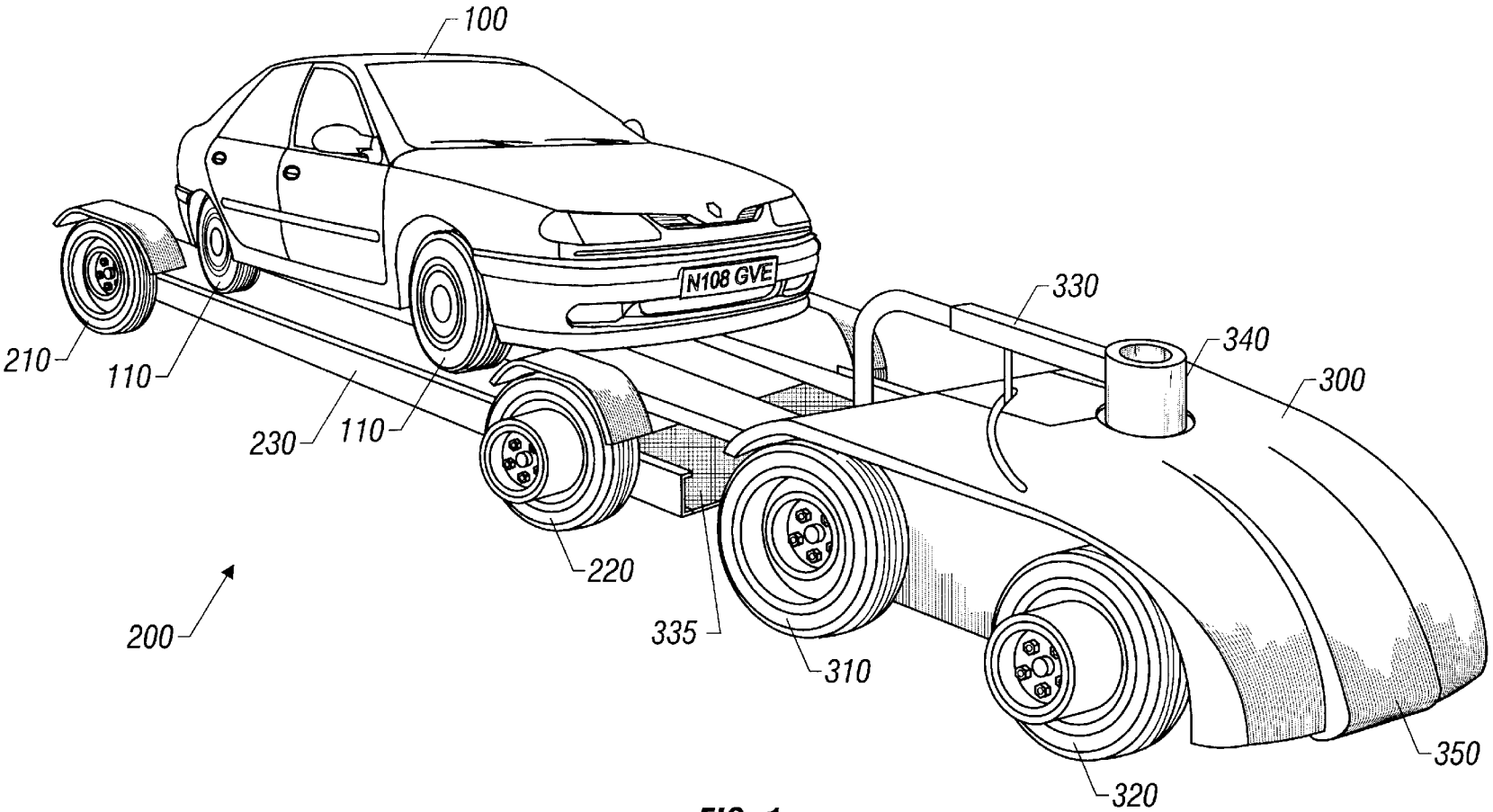
FIG. 1 is a pictorial view of an automobile transport unit of the present invention showing a cable car, a pallet, and a car being transported.

Turning now to FIG. 1, there is shown a pictorial view of an automobile transport unit of the present invention showing a cable car 300, a pallet 200, and a car 100 being transported. The primary vehicle of this unit is the pallet 200 on which cars, vans, light trucks, and other self-propelled land vehicles can be driven onto for transport. For that matter, heavy or bulky loads of freight or other goods and materials may be carried or transported on the pallets 200.

Figure 2:
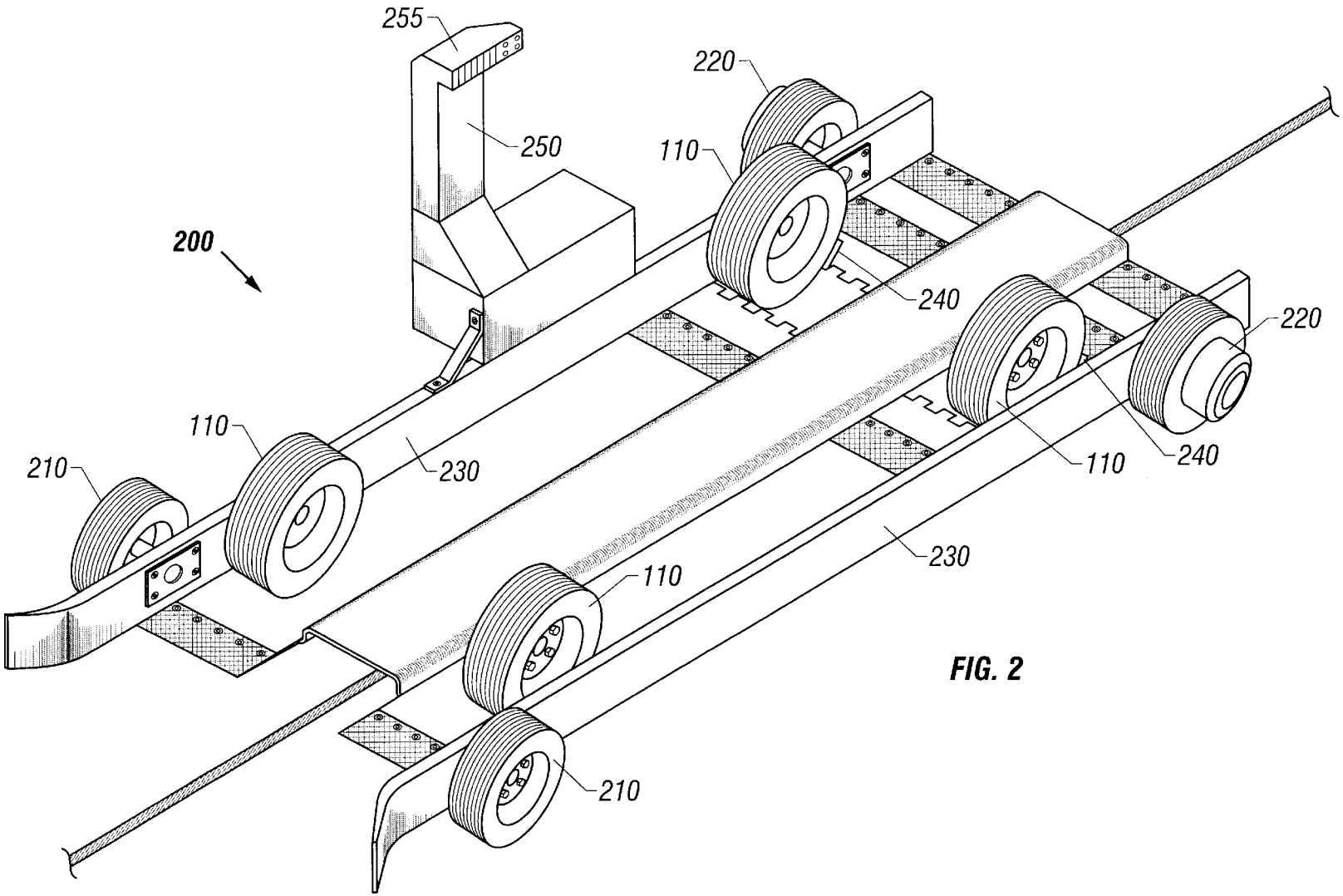
FIG. 2 is a pictorial view of the pallet.

FIG. 2 is a pictorial view of the pallet 200. The rear wheels 210 and front wheels 220 of the pallet 200 are connected to a deck 235 that is three inches off ground level. The deck 235 includes integral outer rails 230 within which the wheels 110 of the car 100 being transported are contained. Front wheels 220 of the pallet 200 include electrical motors. The deck 235, rails 230, and wheels 210 and 220 serve as the main structural member or frame that supports the transported car 100. A supplemental power supply 250 includes a control console 255 that fits inside the driver's-side window of the car 100 to supply such comfort features as heating and air conditioning, audio equipment, mobile cellular telephone, and a radio for two-way communication with a central dispatcher.

Figure 3:
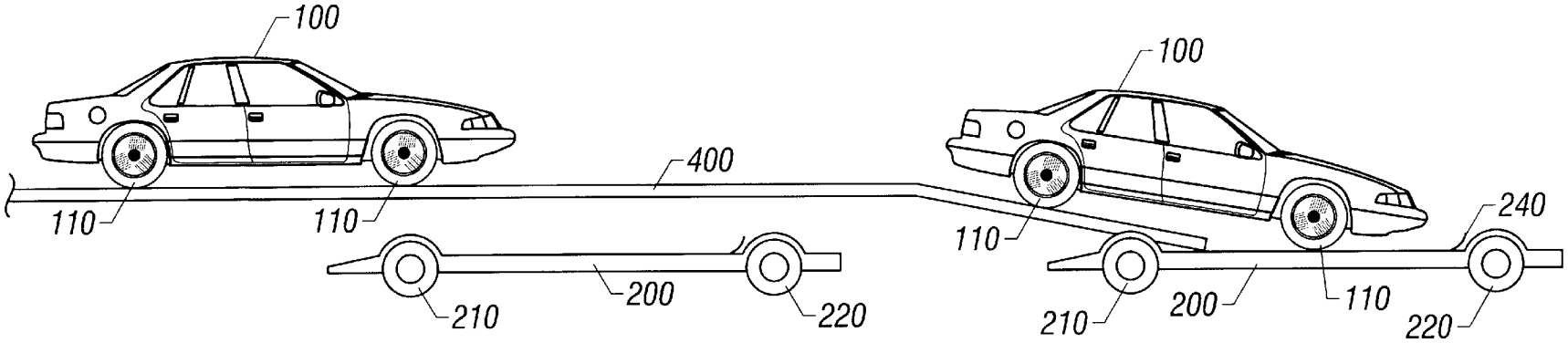
FIG. 3 is a schematic showing the car being loaded down a ramp onto the pallet.
Figure 4:
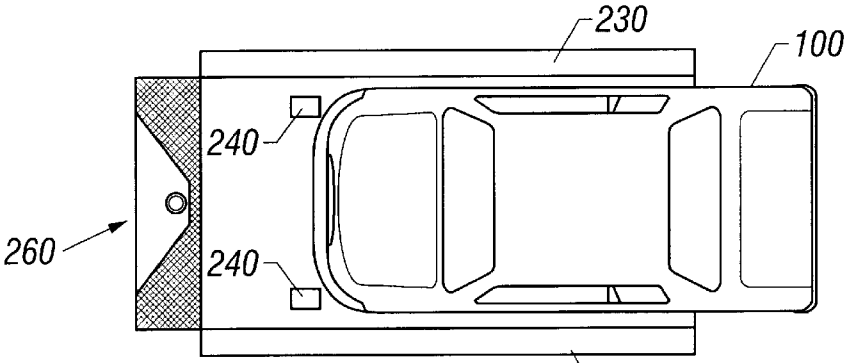
FIG. 4 is a top view of the car partially loaded onto the pallet.
Figure 5:
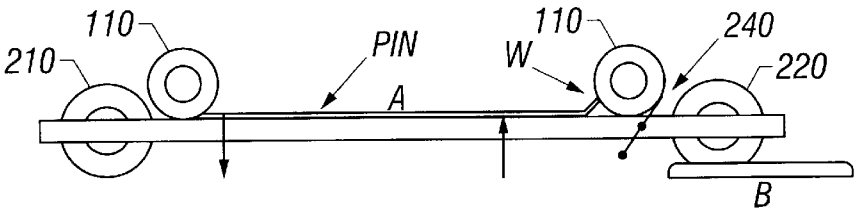
FIG. 5 is a side view of a lock-down device for holding the car onto the pallet.

In one embodiment, the deck 235 has a 6- to 12-inch hinged plate at each end that serves as a ramp for cars to drive on to and off of the deck. In another embodiment, as shown in FIG. 3, the car 100 is loaded or driven down a ramp 400 onto the deck 235 of the pallet 200. FIG. 4 is a top view of a car 100 partially loaded onto the pallet 200. FIG. 5 is a side view of a lock-down device for holding the car 100 onto the pallet 200. Weight on rear wheels forces bar "A" down, causing bar to rise up behind front wheel at "W," prohibiting front wheel from rolling backward. Stop plate "S" keeps wheel from rolling forward. When car moves over bumper "B," stop plate "S" is forced to swing back, allowing car to drive over "S." Forward motion of rear wheels force bar "A" down so rear wheels can cross over.

Figure 6:
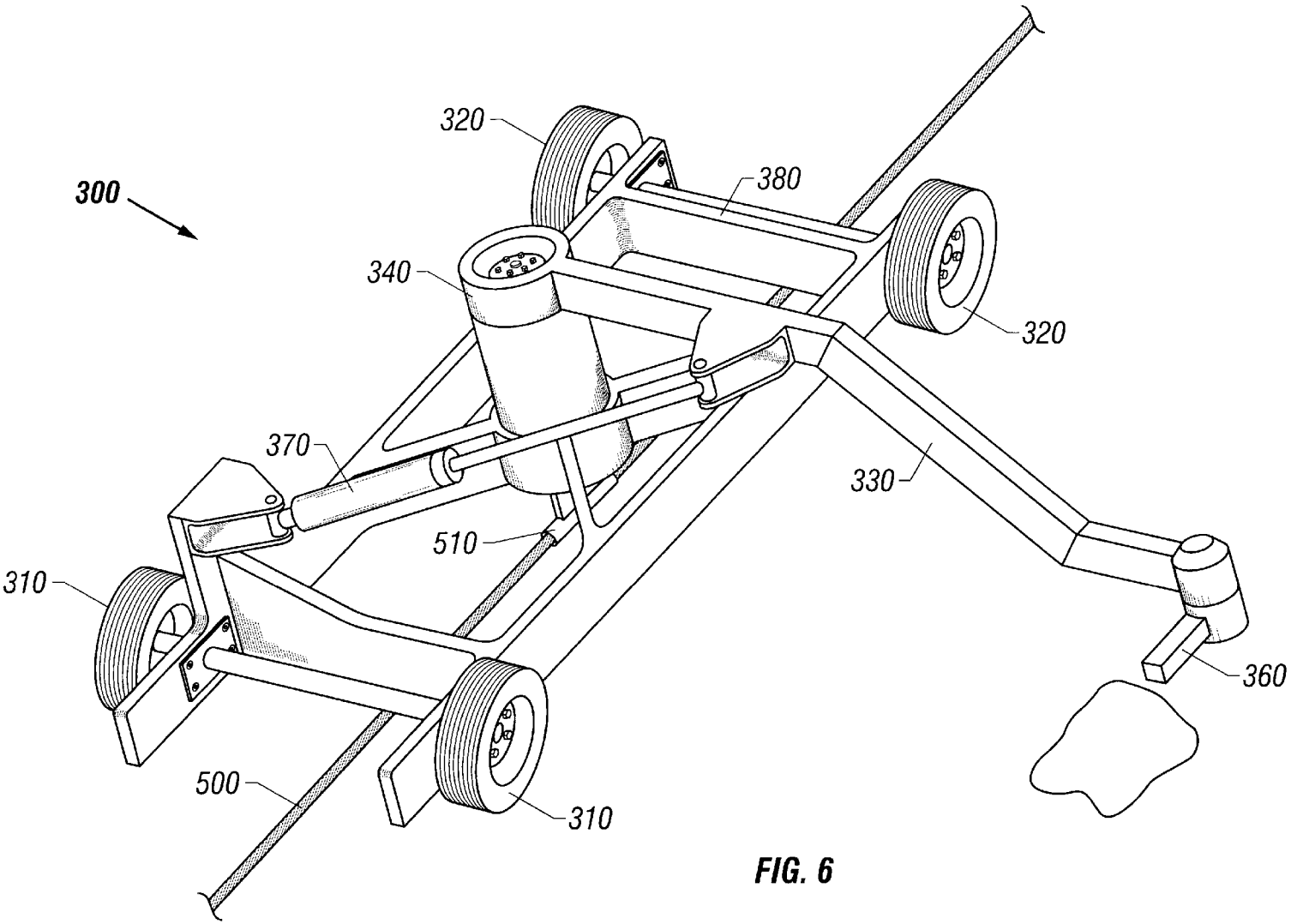
FIG. 6 is a pictorial view of the cable car.

Turning now to FIG. 6, there is shown a pictorial view of the cable car 300 of the present invention. The cable car 300 has rear wheels 310 and front wheels 320 which include electric motors. The cable car 300 serves two purposes—to connect the automobile transport units of the present invention securely to a cable 500 and to maneuver the pallet 200 from the access lane onto the main guideway, and back. The cable 500 is best visualized as an endless belt with cable car units 300 clamped to the cable 500 every 30 to 40 feet. In general, the cable car is about 5 feet long and the pallet 20 feet long, leaving from about 5 to about 10 feet space between transport units. The cable 500 can be a steel cable, wire cable, rope, chain drive, or other flexible device of connected links.

Generally, the cable car 300 is a metal frame 380 with wheels 310 and 320. As seen in FIG. 1, the cable car 300 may have a closed body made of sheet metal, fiberglass, plastic, or composite-material panels. This body may be attached to the frame 380 through rubber mounts or similar construction. One or more cable attachments or clamps 510 extend from the frame 380 down into a gap in the roadway and attach to the cable 500. Drainage structures for removing water from the roadway gap may be needed. The cable clamp 510 permits torsion tension on the cable 500 to be dissipated while maintaining a fixed longitudinal position. Mounted on top of the cable car 300 is an axis 340 with a boom or arm 330 that can move or rotate from about 70 to about 110 degrees, preferably 90 degrees, from a point roughly perpendicular to the body of the frame 330 to a point roughly parallel to the body of the frame 330 of the cable car 300.

Figure 7:
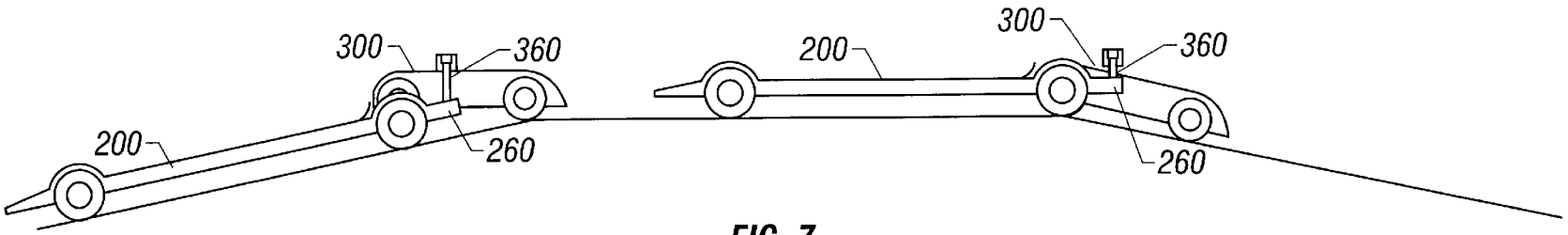
FIG. 7 is a schematic showing the pallet being coupled to the cable car at an on ramp and the pallet being uncoupled from the cable car at an off ramp.
Figure 8:
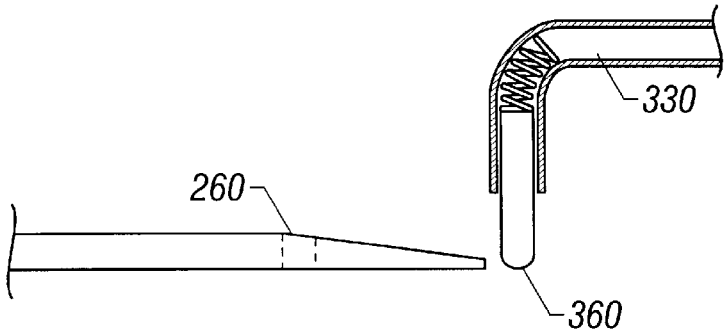
FIG. 8 is a side view of the pallet being coupled to the cable car.
Figure 9:
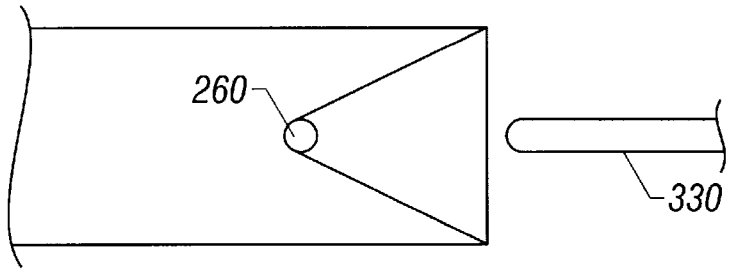
FIG. 9 is a top view of the pallet being coupled to the cable car.
Figure 10:
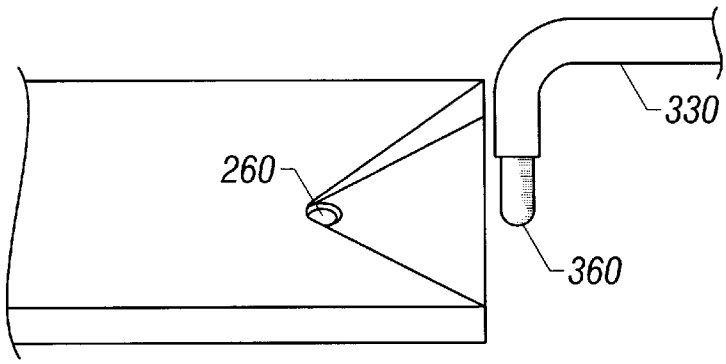
FIG. 10 is a perspective view of the pallet being coupled to the cable car.

As shown in FIG. 7, the arm 330 of the cable car 300 swings out over the access lane to couple with a pallet 200 at an on ramp of the guideway. This allows the pallet 200 to enter the main guideway at operating speed. In a similar fashion, the arm 330 swings back on to the main guideway after the pallet 200 is uncoupled from the cable car 300 at an off ramp. FIGS. 8, 9, and 10 illustrate side, top, and perspective views of the pallet 200 being coupled to the cable car 300. The coupling pin 360 of the cable car 300 slides into the coupling slot 260 of the pallet 200. After engagement, the arm 330 swings back onto the main guideway, positioning the pallet 200 behind the cable car 300.

Depending upon the circumstances, the pallet 200 and cable car 300 may have suspension devices such as springs or shock absorbers to support the weight of the vehicle or cargo and to absorb road shock while allowing the pallet 200 and cable car 300 to steer over a wide range of speed and load conditions. The suspension increases riding comfort, improves safety, and reduces strain on vehicle components, occupants, and cargo.

Figure 11:
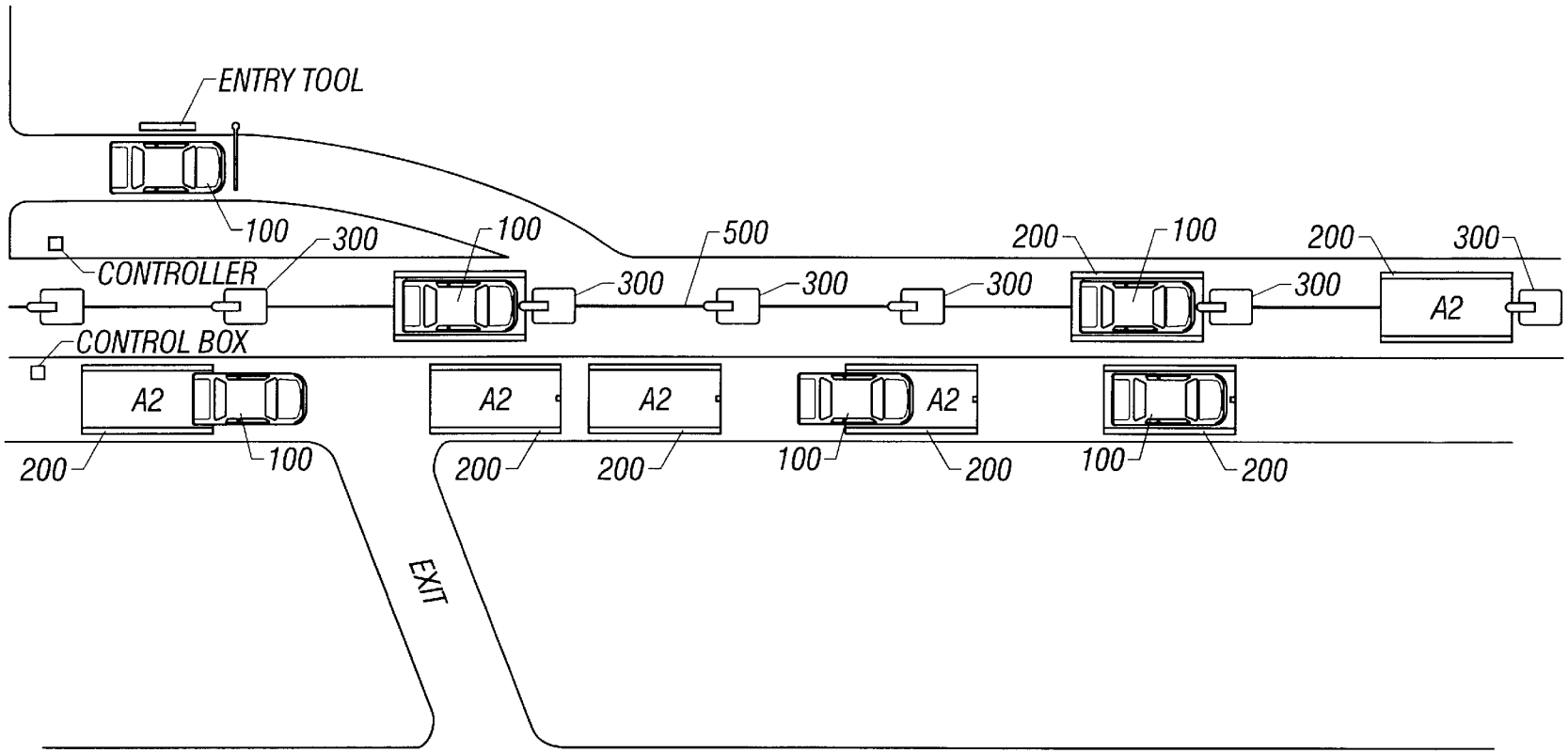
FIG. 11 is a schematic showing the automobile transport unit of the present invention with a plurality of cars, pallets, and cable cars.

FIG. 11 is a schematic drawing of the automobile transport unit of the present invention showing a plurality of cars 100, pallets 200, and cable cars 300. As discussed above, the present invention actualizes the pallet concept. The distinguishing feature of this system is that it does not rely on electronics for spacing. Vehicles are physically separated from each other by a cable 500, therefore, they cannot crash into one another, nor can they leave the roadway. Unlike a ski lift, the cable 500 plays no part in propelling the vehicles along the roadway. Each vehicle is propelled by its own electric motor. The cable 500 just keeps all vehicles secured in their proper place. The result is a track with cable cars 300 spaced apart about every 40 feet and they all hook together traveling 60 miles per hour guided by sensors in the roadway.

To achieve entry and exit from the roadway or guideway without starting and stopping the entire system, the automobile transport unit is made in two parts the cable car 300 which stays clamped to the cable 500 and maintains speed, and the pallet 200 which enters and exits the guideway by coupling and decoupling with the cable car 300. The guideway can be on either the inside or outside lane of a conventional roadway. It can be at grade level or elevated. Cars 100 exit the highway and drive into the loading area. A pallet 200 emerges from an underground tunnel and the car 100 drives onto it. In the adjoining lane are all of the cable cars 300 running at a continuous speed. The pallet 200 signals the appropriate cable car 300 to extend the pickup arm 330. The pallet 200 hooks up with the cable car 300 by coupling pin 360 and coupling slot 260 and is guided onto the guideway. Upon reaching the driver's destination, any cars 100 wanting to exit signal the cable car 300 which swings the pallet 200 out of the line of the guideway. The pallet 200 stops, the car 100 drives off, and then the pallet 200 moves forward and goes underground to emerge up under the next car 100.

In operation, a car leaves the highway and drives into the pallet loading area. When a pallet is in position, a cross arm goes up and the car releases the brakes, and gently rolls down onto the pallet deck. The car's weight is a signal for the pallet to move forward pulling the car entirely onto the deck. The rear wheels signal for the front wheels to be locked down. At the same time a signal is sent to a cable car crossing a certain point of the guideway to extend a pickup arm. The pallet accelerates to 60 miles per hour or greater in order to rendezvous with the cable car at a precise position. The pallet lane is 3 inches below the cable car lane and as the two units connect, the two lanes level off causing the pickup arm to be mechanically attached to the pallet—that is, when they come together, the pallet is 3 inches below the pickup arm. As the lanes become level, the pallet raises 3 inches up around the arm of the cable car securely locking it in place. It is just the reverse in disengaging. The pallet drops 3 inches down from around the arm and is free of the connection. It is a fail-safe protective procedure.

The pallet access ramp has an electric rail that provides power for acceleration. At the point the pallet and cable car hook up, the power rail ends causing the pallet to lose power. It then swings in behind the cable car just as a trailer would. When the pallet gets into this position it is connected to the main power rail and starts powering itself. It remains in this position until ready to exit. A signal is sent to the cable car which guides the pallet out onto the exit ramp. The pallet comes to a stop, the car drives away and enters the highway, and the pallet moves forward through a tunnel to the loading ramp. To change directions and to change speeds, pallets are guided to an off ramp to go wherever their preset sensor guides them. The pallets speed up or slow down to match the connecting ramp. In some circumstances, there would be a need to have multiple loading of cars to be transported, for example, where four cars could be loaded at once. Likewise, multiple unloading can be accommodated upon completion of the trip. If a pallet should fail to hook up with a cable car, it will recycle and come back around.

The guideway will normally operate from 5 a.m. to 10 p.m. Cable cars will be permanently attached to the cable at all times. Normally, fifty percent of the cable cars will be transporting pallets. A continuous count of pallets in use will provide for about a ten percent surplus of empty pallets at all times. Also, an inventory of ten pallets will be available for loading at every entry ramp. As soon as a pallet is loaded, the guideway controller directs an empty to take its place in inventory. As the traffic load picks up, additional pallets are put into the guideway to maintain a 10% surplus at all times. In peak traffic hours, nearly all the pallets will be in service. As the peak load falls, pallets can be pulled off the guideway or simply have their motors cut off so that they are not consuming power and are merely being pulled along by the cable. All pallets have a unique identification code assigned to it, and power can be cut on and off by remote signals. Information obtained by traffic counters and weigh stations can be used in planning operation hours, number of cable cars, and pallet supply.

A traveler uses the automobile transport unit by entering the premises of an entry ramp through a toll gate. The car is weighed remotely, and the driver inputs his destination in the toll gate. Calculation of weight and distance determine the fare, and it is displayed to the driver. If acceptable, a card is swiped or coins deposited, and a green signal to proceed is given. The driver follows the markings leading to the pallets and drives up on the pallets deck, not unlike entering a car wash. The front wheels touch a stop plate activating a plate to be positioned behind the front wheels, effectively locking the car to the pallets. The driver pulls the console into the window, seals off the unit, and presses the ready button. This sends a signal to a controller positioned along the guideway that the pallets is ready to enter. The pallets moves ahead 30 feet to wait for the signal to go. Another pallets advances into the loading spot.

When the next empty cable cars goes by, the controller signals the pallets to go. The pallets accelerates along the access lane up to 65 miles per hour which times it to arrive just behind the cable cars. The cable cars has extended the arm 90 degrees in the path of the pallets. The pallets moves up against the arm causing the projecting arm to enter the tube on the pallets, effectively locking the two units together. At this point, the pallets loses power because the access power rail has ended. The pallets slows, and the arm returns back over the cable cars, positioning the pallets to the rear and against the cable cars. Power flows from the guideway power rails through the cable cars into the pallets, allowing it to regain momentum of about 60 miles per hour. All pallets units in the guideway are speed controlled by a pressure switch between the pallets and cable cars so that a slight positive pressure is exerted on the cable cars, which is conveyed to the cable, effectively providing momentum to the cable. The negligible weight of the ½ inch cable is supported by the wheels of the cable cars, and the slight additional energy from the pallets moves the cable. It should be understood that the cable cars and pallets propel themselves. This is different from all other systems like ski lifts where the cable provides the power. This way, speed and distance are not limited by the cable.

The pallets has the desired exit number programmed into the console. As the vehicles travel down the guideway, each exit controller sends out a signal identifying the exit. If there is a match of the exit numbers, the cable cars arm swings the pallets out into the exit lane running alongside the guideway. As soon as the arm is fully extended, a sensor sends a signal to the coupling lock, and the two vehicles separate. In the event the cars did not uncouple while the pallets was in the exit lane, it would run over a vertical bar that would slide against the lock on the coupling bar and manually cause the lock to be opened and the two cars would pull apart. In either instance, the pallets is no longer receiving power and brakes to a gentle stop. The car drives off the pallets and on to its final destination. The pallets is programmed so that when the weight is off the deck, it starts up and moves forward at 5 miles per hour until it reaches the nearby loading area where it stops and waits for the next car to drive on.

Other mishaps are that the pallets and cable cars fail to engage in the access lane. The pallets comes to a stop, the car drives off the pallets, obtains a refund token, and returns to the toll gate to reenter the system. If the pallets and the cable cars should somehow become unhooked while on the transit way, the pallets would continue being pushed until ready to exit. If the entire system lost power, all the vehicles would coast to a stop.

In summary, the traveler never leaves the comfort of their car to be conveyed electrically to near their destination. The system is mainly manually controlled to provide utmost safety and low cost. Existing technology and right-of-way afford implementation now. The need is urgent to relieve congestion, reduce oil imports, abate pollution, and increase productivity.

This concept is such a departure from conventional thinking, that it is helpful to review the auto train. Amtrak has been shuttling people and their cars from the upper East Coast to Florida for years. Their literature points out the convenience of staying off the congested freeways and still having their car when they arrive. A ferry boat is even more similar in that people usually stay in their car for short trips. The automobile transport unit of the present invention is somewhere between the long distance train and the short distance ferry ride. Remember the three goals of an effective mass transport system—reduce congestion, reduce pollution, and reduce accidents. With this unit, there is a fourth goal—to reduce the nation's reliance on imported oil and the balance of payments deficit.

Although the present invention and its advantages have been described in detail, it should be understood that various changes, substitutions, and alterations can be made without departing from the spirit and scope of the invention as defined by the appended claims.

What is claimed is:

1. A method for transporting vehicles comprising the steps of: loading a vehicle on a pallet, having at least one self-propelled wheel, coupling the pallet to an apparatus having at least one self-propelled wheel and means for connection to an endless cable; connecting said apparatus to said endless cable which acts a guide to maintain said pallet on a fixed and predetermined path and; unloading said vehicle from said pallet.

2. The method of claim 1, in which said pallet has means for locking and unlocking at least one wheels of a transported vehicle to a platform disposed on said pallet.

3. The method of claim 2, wherein said means for locking and unlocking said wheels is actuated by the weight of a transported vehicle.

4. The method of claim 1, wherein the apparatus attached to said cable guide travels at a fixed speed and the pallet having the vehicle disposed thereon is brought from a slow speed or stop to the speed of the apparatus before coupling said pallet to said apparatus.

5. The method of claim 1 wherein said at least one wheel of said pallet is propelled by an electric motor directly connected to said wheel.

6. A vehicle transporting system comprising;

a plurality of pallets having at least one self propelled wheel, means for loading vehicles onto said pallets, means for coupling said pallets to corresponding apparatus having at least one self-propelled wheel;

means for connecting said apparatus to an endless cable system that acts as a guide for keeping said pallets on a fixed and predetermined path.

7. The transporting system of claim 6 further having means for locking and unlocking at least one wheel of said transported vehicle to a platform of said pallet.

8. The system of claim 6 further having a means for continuous loading of vehicles onto said pallets and for accelerating the speed of said pallets to match the speed of the apparatus wherein the apparatus is moving a constant speed.

* * * * *